US011770648B2

(12) United States Patent
Mendes et al.

(10) Patent No.: US 11,770,648 B2
(45) Date of Patent: Sep. 26, 2023

(54) INFINITE BAFFLE WITH LOW STIFFNESS

(71) Applicant: DEVIALET, Paris (FR)

(72) Inventors: Eduardo Mendes, Chabeuil (FR); Bérenger Roig, Paris (FR)

(73) Assignee: DEVIALET, Paris (FR)

( * ) Notice: Subject to any disclaimer, the term of this patent is extended or adjusted under 35 U.S.C. 154(b) by 230 days.

(21) Appl. No.: 17/298,795

(22) PCT Filed: Dec. 3, 2019

(86) PCT No.: PCT/EP2019/083498
§ 371 (c)(1),
(2) Date: Jun. 1, 2021

(87) PCT Pub. No.: WO2020/115044
PCT Pub. Date: Jun. 11, 2020

(65) Prior Publication Data

US 2022/0030351 A1 Jan. 27, 2022

(30) Foreign Application Priority Data

Dec. 3, 2018 (FR) ..... 1872229

(51) Int. Cl.
*H04R 1/28* (2006.01)
*H04R 7/18* (2006.01)
(Continued)

(52) U.S. Cl.
CPC ..... *H04R 1/2811* (2013.01); *H04R 1/02* (2013.01); *H04R 1/42* (2013.01); *H04R 7/18* (2013.01);
(Continued)

(58) Field of Classification Search
CPC ..... H04R 1/02; H04R 1/2811; H04R 1/42; H04R 7/18; H04R 7/26; H04R 9/06; H04R 9/066; H04R 11/02; H04R 2400/11
See application file for complete search history.

(56) References Cited

U.S. PATENT DOCUMENTS 2,810,021 A 10/1957 Brownscombe
2,846,520 A 8/1958 Brownscombe
(Continued)

OTHER PUBLICATIONS

International Search Report dated Feb. 3, 2020 in International Application No. PCT/EP2019/083498.
(Continued)

*Primary Examiner* — Huyen D Le
(74) *Attorney, Agent, or Firm* — B. Aaron Schulman, Esq.; Stites & Harbison, PLLC

(57) ABSTRACT

Infinite acoustic baffle (10) comprising a box (12) and a loudspeaker (20) comprising a membrane (22) that is movable relative to the box (12), the box (12) and the membrane (22) defining a substantially closed baffle chamber (14); the loudspeaker (20) comprising an electrically controlled motor (30) for actuating the membrane (22) that is able to move relative to the box (12), the baffle also comprising a mechanism (50) for axially urging the membrane (22) away from its median rest position counter to the pressure force exerted on the membrane (22) by the gas contained in the box (12) characterized in that the mechanism (50) comprises a cam (54) that is movable relative to the box (12) along an axis (X-X) for displacing of the cam under the displacement action of the membrane (22) and at least one cam follower (58A, 58B) that is biased transversely to the cam (54) by at least one spring (60A, 60B) and bears on the cam (54), the cam (54) having at least one cam surface (56A, 56B) capable of converting the transverse force of the or each spring (60A,
(Continued)

60B) into an axial force on the cam (54), the intensity of which varies depending on the position of the cam (54) relative to the box (12).

10 Claims, 4 Drawing Sheets

(51) Int. Cl.

| | |
|---|---|
| ***H04R 9/06*** | (2006.01) |
| ***H04R 11/02*** | (2006.01) |
| ***H04R 7/26*** | (2006.01) |
| ***H04R 1/02*** | (2006.01) |
| ***H04R 1/42*** | (2006.01) |

(52) U.S. Cl.
CPC ..... *H04R 7/26* (2013.01); *H04R 9/06* (2013.01); *H04R 11/02* (2013.01); *H04R 2400/11* (2013.01)

(56) References Cited

U.S. PATENT DOCUMENTS

| | | | | |
|---|---|---|---|---|
| 4,564,727 | A * | 1/1986 | Danley ..... | H04R 23/00 381/87 |
| 4,607,382 | A | 8/1986 | Dijkstra et al. | |
| 5,060,274 | A * | 10/1991 | Asami ..... | H04R 1/42 381/166 |
| 5,748,759 | A | 5/1998 | Croft et al. | |
| 7,885,418 | B1 | 2/2011 | Hallman | |
| 2004/0156523 | A1 | 8/2004 | Tuason et al. | |

OTHER PUBLICATIONS

Written Opinion dated Feb. 3, 2020 in International Application No. PCT/EP2019/083498.

Preliminary Search Report dated Sep. 6, 2019 in French Application No. 1872229.

* cited by examiner

INFINITE BAFFLE WITH LOW STIFFNESS

The present invention comprises an infinite acoustic baffle of the type comprising a box and a loudspeaker comprising a membrane that is movable relative to the box, the box and the membrane defining a substantially closed baffle chamber; the loudspeaker comprising an electrically controlled motor for actuating the membrane that is movable relative to the box, the baffle further comprising a mechanism for axially urging the membrane away from its median rest position counter to the force of pressure exerted by the gas contained in the box on the membrane.

The sound produced by a loudspeaker is obtained by the displacement of a movable membrane. This membrane has its own resonance frequency linked to its mass and to the stiffness of its suspensions which give it mobility. As a first approximation, for oscillatory displacement frequencies of the membrane above its mechanical resonance frequency, the force required to displace the membrane at constant amplitude oscillatory acceleration is almost constant. However, below its mechanical resonance frequency, the force required to move the membrane with an oscillatory acceleration of constant amplitude increases sharply as the frequency of the oscillatory movements decreases due to the preponderance of suspension stiffness as compared to the mass. Thus, loudspeaker designers have sought to obtain the smallest possible mechanical resonance frequency of the baffle membrane, with its suspensions, because this resonance frequency sets the low operating frequency of the loudspeaker.

The acoustic efficiency of a loudspeaker in the open air is reduced because of the acoustic short circuit due to the reciprocal cancellation of the "front" and "back" waves produced by the loudspeaker membrane. To avoid this cancellation, loudspeakers are usually placed in boxes so that only one wave produced by the membrane is diffused, for example the forward wave produced by the front of the membrane. The opposite wave is confined within the baffle.

In the case of an infinite baffle, the mechanical resonance frequency of the membrane increases as the internal volume of the box decreases. This is due to the air compression/decompression inside the box during the oscillatory movements of the membrane. Indeed, the air compression/decompression behaves like a non-linear spring whose stiffness depends on the box volume and the amplitude of the membrane movement.

Because of this increase in the resonance frequency of the loudspeaker due to the decrease in the volume of the box in which it is placed, baffle manufacturers are forced to use large speakers in order to obtain low-frequency sound reproduction at high sound volumes, since the membrane movement will be all the higher as the frequency of the sound to be reproduced will be low.

To solve this general problem, linking the membrane to an anti-spring mechanism, in order to reduce the equivalent stiffness value seen by the membrane, is known.

With this anti-spring mechanism, it is possible to make infinite baffles of reduced internal volume with sufficiently low resonance frequencies of the membrane to reproduce low frequency sounds.

To create this anti-spring mechanism, various solutions have been proposed, including solutions using pumps to balance the internal and external pressures of the baffle, or elastic blades applied to the speaker membrane.

For example, U.S. Pat. No. 2,810,021 describes a loudspeaker in which the membrane is linked to an axially stressed rod by helical springs positioned radially and connected to the axial rod by an elastically deformable blade in the form of a cup.

The development of such a mechanism is particularly complex, especially since it is very difficult to dimension the springs and the cup as well as the connection means so that the anti-spring mechanism can apply a force of the desired value for each position of the membrane.

The purpose of the invention is to propose an acoustic baffle whose anti-spring mechanism is easier to make, and for which the amount of force applied by this mechanism is well controlled whatever the position of the membrane.

To this end, the object of the invention is an acoustic baffle of the aforementioned type, characterized in that the mechanism comprises a cam that movable relative to the box along an axis for displacing the cam under the action of displacement of the membrane and at least one cam follower biased transversely to the cam by at least one spring and bearing on the cam, the cam having at least one cam surface capable of converting the transverse force of the or each spring into an axial force on the cam, the intensity of which varies depending on the position of the cam relative to the box.

According to particular embodiments, the acoustic baffle comprises one or more of the following features:

- the cam is connected to the baffle membrane by a rod extending along the axis of movement of the membrane;
- it comprises an elastic guide joint connecting the rod to the box;
- the cam is connected to a wall that is movable relative to the box, the movable wall defining with the box a substantially closed rear chamber and a substantially closed front chamber partially defined by the loudspeaker membrane;
- the cam comprises at least two cam surfaces angularly distributed around the cam displacement axis and the mechanism for axially biasing the membrane, for each cam surface, comprises a cam follower biased towards the cam displacement axis and the cam being clamped between the cam followers;
- the or each cam follower comprises a rotating element capable of rolling on the cam;
- the or each cam follower is borne by a pre-stressed elastic arm extending in a plane transverse to the axis;
- the cam comprises an area whose distance from the cam displacement axis 54 is locally constant along the cam displacement axis, this area being in contact with the or each cam follower when the membrane is in the rest position so that no force is applied by the cam on the membrane in this membrane rest position;
- the cam has an inclined area relative to the cam displacement axis.
- the cam area inclination along the inclined area is increases progressively along the cam displacement axis away from the area of contact with the cam follower when the membrane is in its rest position so that the cam imposes a force of increasing intensity on the membrane as the membrane moves away from its rest position.

The invention will be better understood from the following description, given only by way of example and made with reference to the drawings in which.

Figure 1:
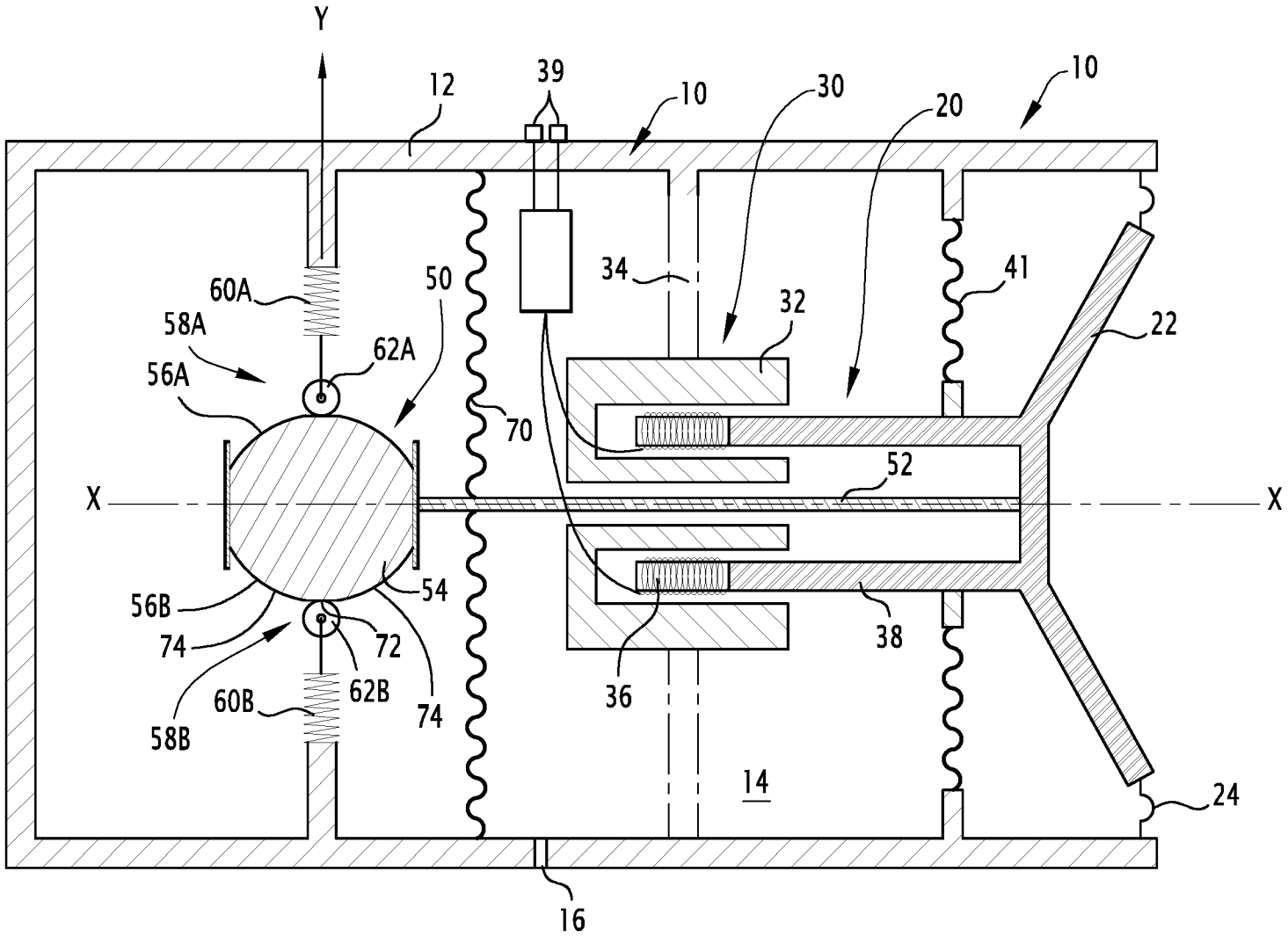
FIG. 1 is a longitudinal section view of a baffle according to a first embodiment of the invention.

The acoustic baffle 10 shown in FIG. 1 is an infinite baffle. It comprises a box 12 delimiting a substantially closed chamber 14 separated from the external environment.

The box 12 comprises rigid and impermeable walls connected to each other. A calibrated decompression vent 16 is provided through one wall to allow pressure equilibration between the interior and exterior of the baffle during slow variations in atmospheric pressure. This decompression vent 16 is small enough to prevent air flow to and from the chamber 14 during operation of the baffle and particularly during movement of the speaker membrane.

As known per se, the baffle comprises a loudspeaker 20 having a membrane 22 that is movable through a hole in the baffle. The membrane 22 locally delimits the chamber 14 and ensures the sealing thereof. The membrane 12 is connected to the side walls of the baffle by a deformable seal 24.

The loudspeaker comprises an electrically controlled motor 30 for actuating the membrane 22 for displacement thereof along an X-X axis. As known per se, the motor essentially comprises an electromagnet, having a casing 32 attached to the box 12 by connecting arms 34 and a coil 36 borne by a movable assembly 38 at the end of which the membrane 22 is borne.

As known per se, the coil 36 is connected to terminals 39 for connecting the acoustic baffle to an amplifier.

The movable assembly 38 is guided in relation to the box 12 for a displacement along the X-X axis by an elastic joint formed by an elastic and air-permeable corrugated textile plate 41 known as a spider. This textile structure delimits air circulation passages enabling pressure equalization on both sides of the spider.

The baffle 10 comprises an anti-spring mechanism 50 acting on the membrane 22 and capable of compensating for the effect of air pressure variations in the chamber 14 during movements of the membrane 22.

In this embodiment, the anti-spring mechanism 50 is an elastic mechanism for axially urging the membrane 22 away from its median rest position counter to the pressure force exerted by the air contained in the chamber on the membrane, i.e., along the direction of movement of the membrane.

The mechanism 50 comprises a rod 52, extending along the axis X-X, connected, at one end, to the movable assembly 38 carrying the membrane 22 and, at its other end, to a cam 54 movable relative to the box 12. The rod 52 is thus driven by the movable assembly 38.

The rod 52 passes axially through the loudspeaker drive motor 30.

The cam 54 is generally rotationally symmetrical with an X-X axis. It has a continuous revolving cam surface forming two diametrically opposed cam surfaces 56A, 56B in a plane passing through the X-X axis. These cam surfaces are axisymmetric relative to the X-X axis.

The cam 54 is clamped between two cam followers 58A, 58B biased transversely to the X-X axis by springs 60A, 60B keeping the cam followers in contact with the cam surfaces 56A, 56B.

Advantageously, the cam followers 58A, 58B each comprise a rotating element 62A, 62B, such as a roller, capable of rolling along the length of the cam surfaces 56A, 56B. The axis of rotation of the rollers extends perpendicular to the X-X axis.

Figure 2:
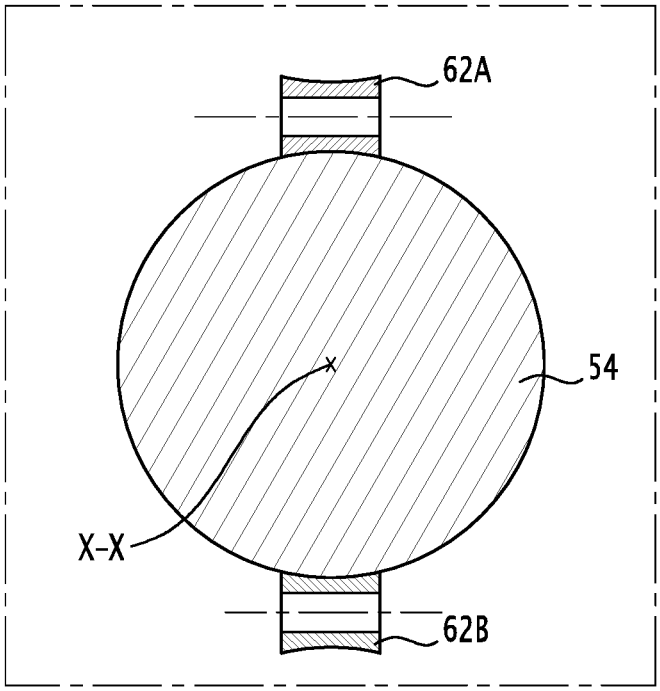
FIG. 2 is a partial section view of the cam and roller of the anti-spring mechanism of the baffle of FIG. 1.

Advantageously, and as illustrated in FIG. 2, the rollers 62A, 62B have a diabolo shape, with a concave surface complementary to the cylindrical surface of the cam 54.

The springs 60A, 60B extend transversely relative to the cam surfaces. They are coaxial with axis Y-Y intersecting axis X-X. These springs are kept constantly compressed and are supported at one end on the box 12 and at their other end on the axis of the rotating rollers 62A, 62B forming the cam followers.

A complementary spider 70, positioned between the cam 54 and the actuating motor 32, ensures the axial guidance of the rod 52 and the cam 54 to ensure a displacement of the latter along the X-X axis. Like the spider 40, the spider 70 is gas permeable.

The cam surfaces 56A, 56B have an area 72 in the middle part, along the length of the X-X axis and in section along the plane of travel of the rollers, whose distance from the X-X cam displacement axis is locally constant along the X-X cam displacement axis. This area 72 extends over a few tenths of a millimeter along the X-X axis. This median area 72 is positioned on the cam so that each roller presses on this median area when the membrane 22 is in the rest position, i.e., in a median position between the two extreme positions that can be occupied under the action of the motor 30.

On either side of this median part, the cam surfaces 56A, 56B have areas 74 inclined relative to the X-X axis. The inclination of these areas increases as they move away along the X-X axis on either side of this median area so that when the cam followers move away from the median area, the angle between the X-X axis and the normal at the point of contact of the roller on the cam surface increases, so that the force applied to the membrane increases.

Thus, the distance between the X-X axis and a point on the cam surface decreases as it moves away from the median area 72. The cam surfaces converge away from the median zone.

The loudspeaker shown in FIG. 1 operates as follows.

Under the action of the electric current applied to the coil 36, the membrane 22 moves, as known per se. As the membrane moves, the cam 54, driven by the membrane, moves axially relative to the cam followers 58A, 58B. The cam followers then exert a force directed along the Y-Y axis toward the X-X axis on the cam surfaces 56A, 56B. With these cam surfaces inclined and held along the Y-Y axis between the two rollers, the cam surface is subjected to an axial force, which is applied to the membrane 22 through the rod 52.

If the membrane 22 is moved towards the interior of the box 12, resulting in air being compressed in the chamber 14, the cam 54 is moved away from the membrane 22. Under the action of springs 60A, 60B acting through cam followers 62A, 62B, cam 54 is biased in its direction of movement.

The excess pressure in the baffle 14 acts on the membrane 22 to move the membrane 22 out of the box 12. In contrast, the cam 54 produces a force to return the membrane 22 into the box. Advantageously, the shape of the cam 54 is adapted so that the sum of the two forces produced by the cam and the force resulting from the excess pressure in the chamber 14 practically cancels at any point on the cam or is equal to a desired value at any point on the cam.

Similarly, when the membrane 22 is pushed out of the box 12 by the motor 30, a vacuum is created inside the chamber 14 to pull the membrane back into the box. In this case, the cam 54 exerts a force on the membrane 22 under the load of the springs 60A, 60B, leading to pushing the membrane 22 out of the box 12, thus compensating for the effect of the depressurization in the chamber 14.

The shape of the cam surface allows a portion of a force $F_{Rz}$ exerted by the springs 60A and 60B along the Y-Y axis to be transformed into a force $F_{Rx}$ along the X-X axis.

At the equilibrium position, x=0 corresponding to the rest position of the membrane 22, the cam surface having an area 72 whose distance from the X-X axis of cam movement is locally constant along the X-X axis of cam movement. The cam surface is such that the force $F_{Rx}$ along the X-X axis applied by the cam to the membrane 22 through the rod 52 is zero. At the equilibrium position, x=0, the rollers press on the median area of the cam surface 54 which is parallel to the X-X axis.

Given the convex shape of the surfaces of the cam 54, the membrane 22 undergoes a force $F_{Rx}$ during its displacement, through the intermediary of the rod 52, along the axis X-X in the same direction as the displacement. The amplitude of this force depends on the angle formed by the surface of the cam 54 with the axis X-X at the point of contact of the rollers 62A, 62B. This force is in the form of:

$$F_{Rx}=K_R(X)\cdot x, \text{ with } K_R(x)\leq 0$$

The stiffness $K_R(X)$ is negative since it produces a force in the same direction as the membrane displacement.

When the membrane 22 is displaced by the action of the current flowing through the coil, several stiffnesses are involved:

$K_m(x)>0$, the stiffness of the assembly formed by the guide joint 24 and the guide spiders 41 and 70;

$K_{air}(x)\geq 0$, the stiffness related to the compression/decompression of the internal air of the chamber 14;

$K_R(X)\leq 0$, the stiffness related to the force produced on the membrane 22 by the biasing mechanism 50.

The static and dynamic stability of the set of moving parts is ensured by the following relationship:

$$K_m(x)+K_{air}(x)+K_R(x)\geq K_{min}>0$$

With $K_{min}$ a positive value to be chosen.

The shape of the cam 52 is chosen so that whatever the position x of the membrane, the sum of the stiffnesses $K_m(x)+K_{air}(x)+K_R(x)$ is close to the desired value $K_{min}$.

Thus, the resonant frequency of the moving mechanical system noted $F_{AR}$ is given by:

$$F_{AR}=\frac{1}{2\pi}\sqrt{\frac{K_{min}}{M+M_{AR}}}$$

where

M is the mass of the movable assembly 38, the winding 36, the membrane 22 and, in part, the seals 24 and 41; and $M_{AR}$ is the moving mass of the rod 52, the cam 54 and, in part, the seal 70.

The shape of the cam is defined as shown below with the following notations:

| | |
|---|---|
| $x = x_C$ | Displacement along X-X of the movable assembly 38<br>x = displacement of the cam $x_c$<br>At rest: x = 0. x > 0 for a displacement to the left. |
| $F_T = K_T(x)x$ | Force to be compensated (box + suspension of the movable assembly), with $K_T(x) = K_m(x) + K_{air}(x) > 0$<br>The force $F_T$ opposes the displacement of the movable assembly<br>Force to the right with positive displacement of the movable assembly to the left. |
| $y_B$ | Displacement of the roller transverse to the X-X axis<br>$y_B < 0$ for a displacement transversal to the X-X axis towards the X-X axis. $y_B = 0$ for x = 0 |
| $F_{yB} = k_B(y_B) \cdot (Y_{B0} + y_B)$ | Force exerted by the roller on the cam<br>Force exerted downwards, in the y < 0 direction<br>$Y_{B0}$: pre-compression of the roller spring |
| $F_{Rx} = -F_{yB} \cdot \tan(\alpha)$ | Angle of transformation of the roller force.<br>For an angle $\alpha > 0$, the force $F_{Rx}$ opposes the force $F_T$ |
| $\alpha_C = \alpha$ | Angle at the roller-cam contact point between the transverse to the X-X axis at the contact point and the normal to the surface at the contact point. Same angle as given by the slope of the cam at the point of tangency. |
| $(x_{BC}, y_{BC})$ | Equation of the cam = Contact point roller-cam |
| $x_{BC} = x - r_B \sin(\alpha)$ | Position along X-X of roller force application with $r_B$ roller radius |
| $y_{BC} = y_B + r_B(1 - \cos(\alpha))$ | Position transverse to the axis X-X of the contact point of the roller on the cam |

The profile 4 of the cam is given by the function expressing $y_{BC}$ depending on $x_{BC}$.

$$\text{At equilibrium: } F_{Rx}+F_T=F_{min}$$

with $F_{min}(x)=K_{min}x$ being the residual force remaining after compensation, $K_{min}>0$.

$$\Rightarrow k_B(y_B)\cdot(Y_{B0}+y_B)\cdot\tan(\alpha)=(K_T(x)-K_{min})\cdot x$$

What we are trying to determine: $y_{BC}=f_{came}(x_{BC})$,

With: $x_{BC}=x-r_B\sin(\alpha)$ and $y_{BC}=y_B+r_B(1-\cos(\alpha))$ we get:

$$k_B(y_{BC}-r_B(1-\cos(\alpha)))\cdot(Y_{B0}+y_{BC}-r_B(1-\cos(\alpha)))\cdot\tan(\alpha)$$
$$=(K_T(x_{BC}+r_B\sin(\alpha))-K_{min})\cdot(x_{BC}+r_B\sin(\alpha))$$

From the following geometric relations:

$$\tan(\alpha)=-y'_{BC}=-\frac{dy_{BC}}{dx_{BC}},$$

$$\cos(\alpha)=\cos(a\tan(-y'_{BC}))=\frac{1}{\sqrt{1+y'^2_{BC}}} \text{ and}$$

$$\sin(\alpha)=\sin(a\tan(-y'_{BC}))=\frac{-y'_{BC}}{\sqrt{1+y'^2_{BC}}}.$$

Solving the final nonlinear differential equation yields $y_{BC}$ depending on $x_{BC}$:

$$k_B\left(y_{BC} - r_B\left(1 - \frac{1}{\sqrt{1 + y'^2_{BC}}}\right)\right)\cdot\left(Y_{B0} + y_{BC} - r_B\left(1 - \frac{1}{\sqrt{1 + y'^2_{BC}}}\right)\right)\cdot$$

$$(-y'_{BC}) = \left(K_T\left(x_{BC} + r_B\frac{-y'_{BC}}{\sqrt{1 + y'^2_{BC}}}\right) - K_{min}\right)\cdot\left(x_{BC} + r_B\frac{-y'_{BC}}{\sqrt{1 + y'^2_{BC}}}\right)$$

The value chosen for $K_{min}<K_m(x)+K_{air}(x)$ is used to choose the value of the mechanical resonance frequency $F_{AR}$ of the loudspeaker placed in a closed box. Typically, the value of $F_{AR}$ will be between 30 Hz and 50 Hz. The additional mass $M_{AR}$ brought by the anti-spring mechanism is reduced as much as possible in order to minimize the force, and thus the current, necessary to move the membrane beyond the resonance frequency.

It is understood that the use of a cam and cam follower allows the cam to be sized to produce a force on the membrane 22 that is substantially opposite to the force resulting from the increase or decrease in pressure in the chamber 14. This facilitates the construction of the baffle.

Figure 3:
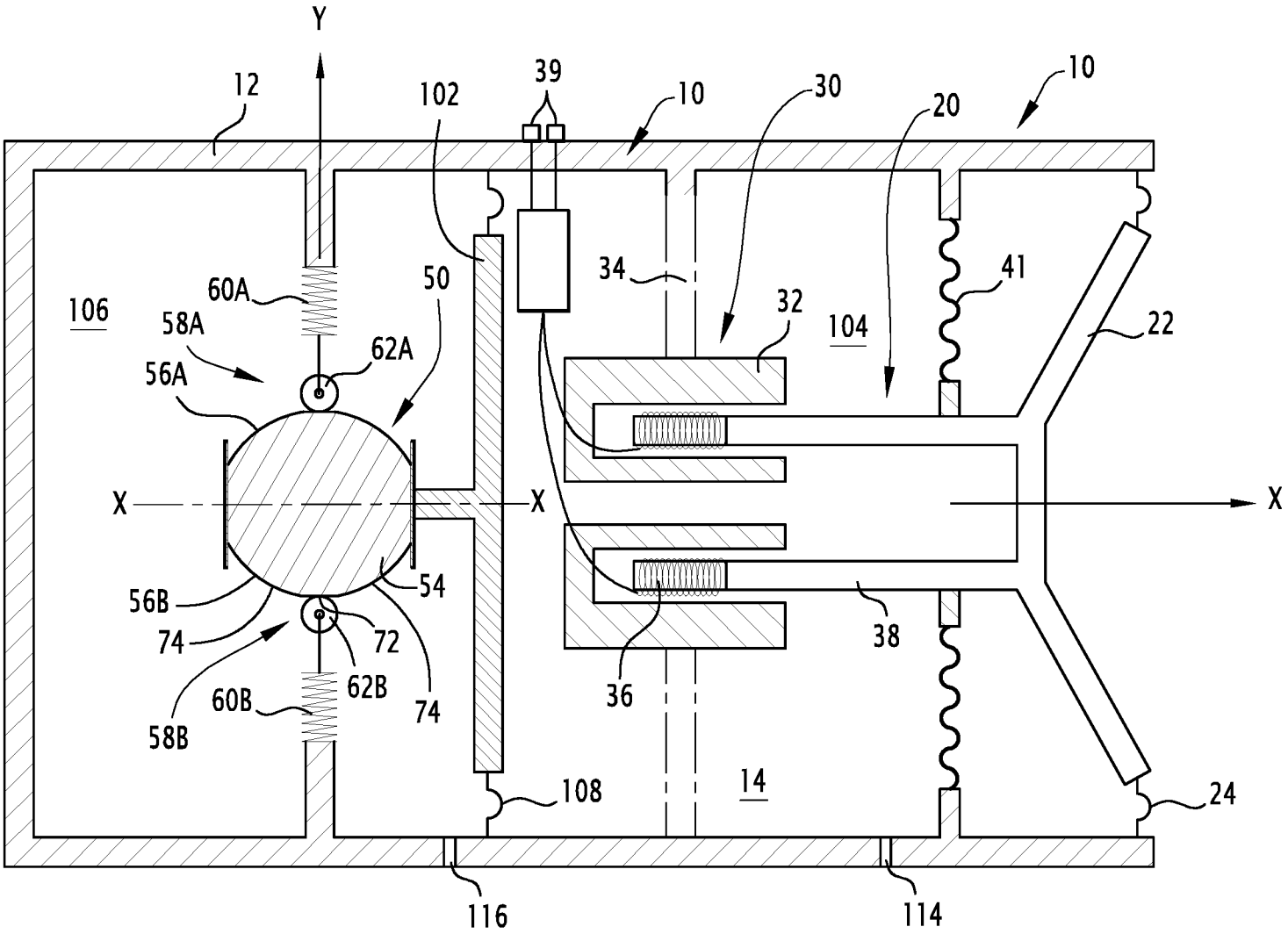
FIG. 3 is a view identical to that of FIG. 1 of a variant embodiment of a baffle according to the invention.

FIG. 3 illustrates another embodiment of an infinite acoustic baffle according to the invention.

In this embodiment, the elements identical or corresponding to those of the first embodiment are designated by the same reference numbers. Only the differences will be described in the following.

In this embodiment, the cam 54 is not connected to the movable assembly by a rod 52. Instead, the cam 54 is connected to a movable wall 102, separating the closed chamber 14 in the box 12 into a front chamber 104 partially delimited by the membrane 22 and the movable wall 102 and a rear chamber 106 delimited by the walls of the box 12 and by the movable wall 102.

The movable wall 102 is a rigid, impermeable wall connected to the walls of the box 12 by a flexible, gas-impermeable seal 108.

In this embodiment, but not necessarily, the wall 102 extends perpendicular to the X-X axis of movement of the cam 54.

When the baffle has multiple loudspeakers, a single rear chamber 106 is provided for two or more loudspeakers whose membranes delimit single front chamber 104 separated from the rear chamber in a single wall 102.

The guiding along the X-X axis of the movable assembly formed by the wall 102 and the cam 54 is ensured by the joint 108 and the rollers 62A, 62B gripping the cam under the action of the springs 60A, 60B.

In this embodiment, a calibrated pressure relief vent 114, 116 connects the front chamber 104 and the rear chamber 106 to the external environment. These vents are small enough to prevent air flow during movement of the membrane 22 but are capable of providing pressure equalization between the exterior and interior of the housing during atmospheric pressure changes.

During the movement of the membrane 22 under the action of the motor 30, the wall 102 moves due to the depressurization or compression in the front chamber 104. Under the action of the movement of the wall 102, the cam 54 is moved and, under the action of the cam followers 58A, 58B, produces a force applied on the wall 102. This force is contrary to the effect of the pressure acting on this same wall 102 and therefore oriented along the direction of displacement of the wall 102. This force is transmitted to the membrane 22 through the gas trapped in the front chamber 104.

It is understood that in this embodiment also, the stiffness of the gas compression in the front chamber 104 is compensated by the force applied by the cam 56 of the axial biasing mechanism 50.

Figure 4:
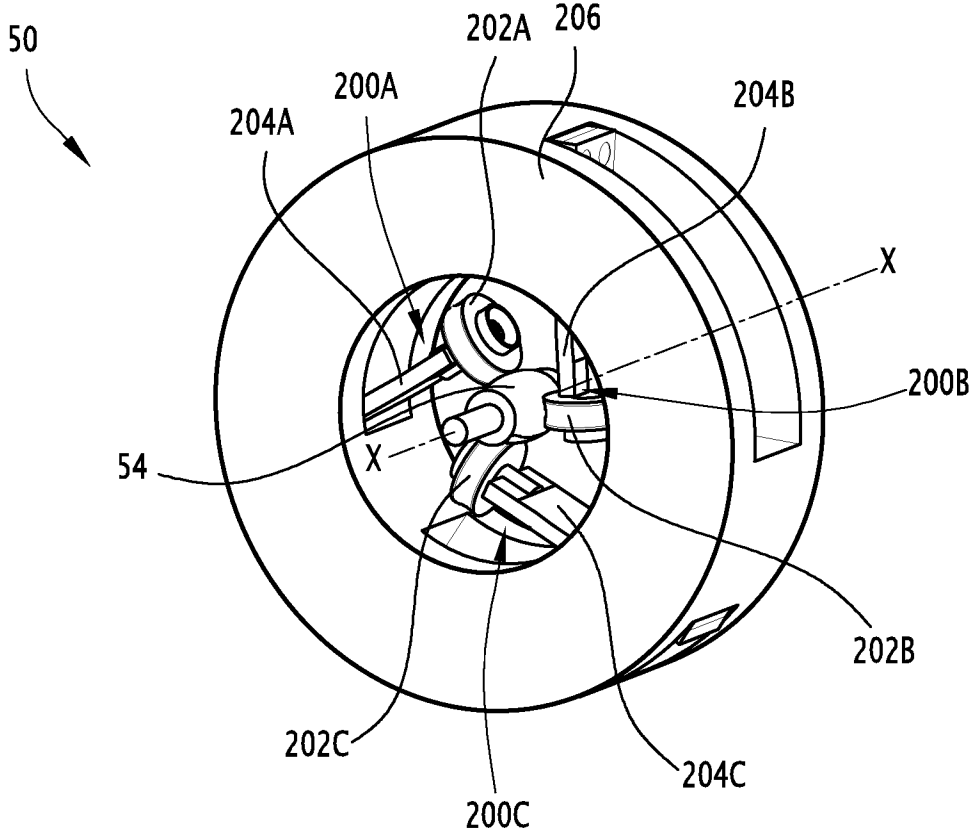
FIG. 4 is a perspective view of a variant embodiment of an anti-spring mechanism of a baffle according to the invention.

FIG. 4 shows a variant embodiment of the anti-spring mechanism 50, which can be implemented in the embodiments of FIGS. 1 and 3 as a replacement for the described mechanism, with all other elements not described in FIG. 4 remaining identical.

In FIG. 4, one can recognize the cam 54 positioned along the X-X axis, connected either directly to the movable assembly carrying the membrane 22, as in FIG. 1, or to the movable wall 102, as in FIG. 3.

The profile of the cam 54 is identical to the profile described with regard to the preceding Figures.

In this embodiment, the cam 54 is clamped between rollers 202A, 202B, 202C, distributed regularly angularly around the axis X-X. These rollers are borne at the free end of elastic arms 204A, 204B, 204C. These elastic arms are each fixed at their other end to a rigid structure 206, itself integral with the box 14.

The arms 204A, 204B, 204C extend perpendicularly to the X-X axis in the same plane. They are offset transversely relative to the X-X axis.

The rollers 202A, 202B, 202C are rotatably mounted in the extension of the axis of the arms 204A, 204B, 204C respectively, and along the axis of the arms. They are capable of rolling along the surface of the cam 54 along the X-X axis.

The arms 204A, 204B, 204C are pre-stressed so as to ensure a permanent contact between the rollers 202A, 202B, 202C and the cam 54, whatever the position of the rollers along the length of the cam 54 considered along the X-X axis.

In this embodiment, the presence of three rotating elements, distributed angularly around the X-X axis, ensures satisfactory guidance of the cam 54 along the X-X axis. The presence of prestressed elastic arms that are deformable by bending ensures a relatively constant force of the rollers 202A, 202B, 202C on the cam, regardless of their position, and prevents the rollers from locking.

The invention claimed is:

1. An infinite acoustic baffle comprising a box and a loudspeaker comprising a membrane that is able to move relative to the box, the box and the membrane delimiting a substantially closed chamber; the loudspeaker comprising an electrically controlled motor for actuating the membrane that is movable relative to the box, the baffle also comprising a mechanism for axially urging the membrane away from its median rest position counter to the pressure force exerted on the membrane by the gas contained in the box characterized in that the mechanism comprises a cam that is movable relative to the box along an axis for displacing the cam under the displacement action of the membrane and at least one cam follower that is biased transversely to the cam by at least one spring and bears on the cam, the cam having at least one cam surface capable of converting the transverse force of the or each spring into an axial force on the cam, the intensity of which varies depending on the position of the cam relative to the box.

2. The acoustic baffle according to claim 1, wherein the cam is connected to the membrane of the loudspeaker by a rod extending along the axis of movement of the membrane.

3. The baffle according to claim 2, wherein it comprises an elastic guide joint connecting the rod to the box.

4. The baffle according to claim 1, wherein the cam is connected to a wall movable relative to the baffle, the movable wall delimiting with the box a substantially closed rear chamber and a substantially closed front chamber delimited in part by the membrane of the loudspeaker.

5. The baffle according claim 1, wherein the cam comprises at least two cam surfaces angularly distributed about the axis of displacement of the cam and in that the mechanism for axially biasing the membrane comprises for each cam surface a cam follower for each cam surface, which are biased towards the axis of movement of the cam, and the cam is clamped between the cam followers.

6. The baffle according to claim 1, wherein the or each cam follower comprises a rotatable element capable of rolling on the cam.

7. The baffle according to claim 1, wherein the or each cam follower is borne by a prestressed elastic arm extending in a plane transverse to the axis.

8. The baffle according to claim 1, wherein the cam comprises an area whose distance from the axis of displacement of the cam is locally constant along the axis of displacement of the cam, this area being in contact with the or each cam follower when the membrane is in a rest position so that no force is applied by the cam on the membrane in this rest position of the membrane.

9. The baffle according to claim 1, wherein the cam comprises on an area inclined relative to the axis of movement of the cam.

10. The baffle according to claim 9, wherein the inclination of the cam surface along the inclined area progressively increases along the axis of displacement of the cam away from the area of contact with the cam follower when the membrane is in the rest position so that the cam imposes a force of increasing intensity on the membrane as the membrane is displaced away from its rest position.

* * * * *